United States Patent [19]

de Bruin

[11] 4,432,161

[45] Feb. 21, 1984

[54] RECEPTACLE FOR CUT FLOWERS

[75] Inventor: Peter de Bruin, Maarheze, Netherlands

[73] Assignee: Coöperatieve Vereniging "Verenigde Bloemenveilingen Aalsmeer" (V.B.A.) W.A., Aalsmeer, Netherlands

[21] Appl. No.: 322,762

[22] Filed: Nov. 19, 1981

[30] Foreign Application Priority Data

Nov. 20, 1980 [NL] Netherlands ..... 8006327

[51] Int. Cl.[3] ..... A01G 5/00; B65D 85/50

[52] U.S. Cl. ..... 47/41 R; 206/423; 206/518; 206/519; 220/94 A

[58] Field of Search ..... 47/41, 75, 66; 206/423, 206/507, 515, 518, 519, 520; 220/94 A; D11/143, 144, 148, 155, 156

[56] References Cited

U.S. PATENT DOCUMENTS

| | | | |
|---|---|---|---|
| 1,507,693 | 9/1924 | Smith | 47/41 X |
| 2,493,633 | 1/1950 | Mart | 206/519 |
| 2,978,780 | 4/1961 | Clarkson | 47/41 X |
| 3,142,936 | 8/1964 | Tweddell | 47/41 |
| 3,661,350 | 5/1972 | Eckler et al. | 47/41 X |
| 3,961,443 | 6/1976 | Insalaco | 206/423 X |
| 4,113,094 | 9/1978 | Collin | 47/41 X |
| 4,200,346 | 4/1980 | Belokin | 206/518 X |
| 4,280,648 | 7/1981 | Boursier | 206/519 X |

FOREIGN PATENT DOCUMENTS

| | | | |
|---|---|---|---|
| 2417962 | 10/1979 | France | 206/518 |
| 11360 | of 1885 | United Kingdom | 47/41 |

*Primary Examiner*—Edgar S. Burr
*Assistant Examiner*—David A. Wiecking
*Attorney, Agent, or Firm*—Becker & Becker, Inc.

[57] ABSTRACT

A receptacle for the storage and transportation of cut flowers. The receptacle has a substantially rectangular horizontal cross section, is manufactured of synthetic material, is provided with handgrips, and is double-walled in such a way as to be composed of an external container which is in the form of a truncated right pyramid facing upwards, and of an internal container which is provided with a substantially horizontal bottom and has the form of a truncated right pyramid facing downwards, the wall of the external container and that of the internal container being connected along the upper edge of the receptacle in such a way that the vertical section through both walls has substantially the form of an inverted "V", each leg of the "V" being inclined at an angle of at least 2° to the vertical; the various parts of the receptacle are mutually dimensioned in such a way that a number of receptacles can be compactly stacked to form a nest.

13 Claims, 2 Drawing Figures

RECEPTACLE FOR CUT FLOWERS

The present invention relates to a receptacle for the storage and transportation of cut flowers, and aims at providing a more efficient embodiment thereof than that of prior-art receptacles for this purpose.

Cut flowers are selected by the florist, are bunched, and, whether or not packaged, are placed into a receptacle for conveying them to auction. Following inspection, the flowers are auctioned and are subsequently distributed to the various buyers (mainly retailers). The bunches of cut flowers are then generally removed by the buyers from the receptacles, are placed into their own receptacles, and are conveyed further, with the empty receptacles being returned to a central point, from where they can again be made available to the florists. The dealers, having returned to their places of business, arrange the various kinds of cut flowers for retailing them to the end users, the consumers.

Summarizing, it is seen that receptacles for cut flowers are required mainly in three areas of handling: in the flower-growing area, in the auctioning area, and in the area of dealer and buyer contacts. In between are the areas of transportation, transshipment, and storage, and in addition the areas of warehousing and cleaning empty receptacles.

If the receptacle is to perform adequately in all of these areas, it must satisfy a number of widely different demands. It must be sturdy and rigid, so as to resist rough handling when the filled receptacle is placed in or on the vehicles for transportation of the flowers to the auction, during unloading at the auction site, and furthermore during the loading and unloading of the stacking trucks used for handling at the auction. The receptacle should also be easy to handle, so as to allow loading and unloading to be accomplished quickly and without excessive effort. Other requirements to be met are that the flowers must be clearly visible during inspection and auctioning; that the bunches can be removed from the receptacle easily and without damage; and finally that empty receptacles can be nested to form stable stacks.

There has heretofore been no receptacle for cut flowers which was so designed that all these requirements were satisfied, and which could be used with adequate efficiency in all of the aforementioned areas.

It is therefore an object of the present invention to provide such an efficient receptacle for cut flowers.

Figure 1:
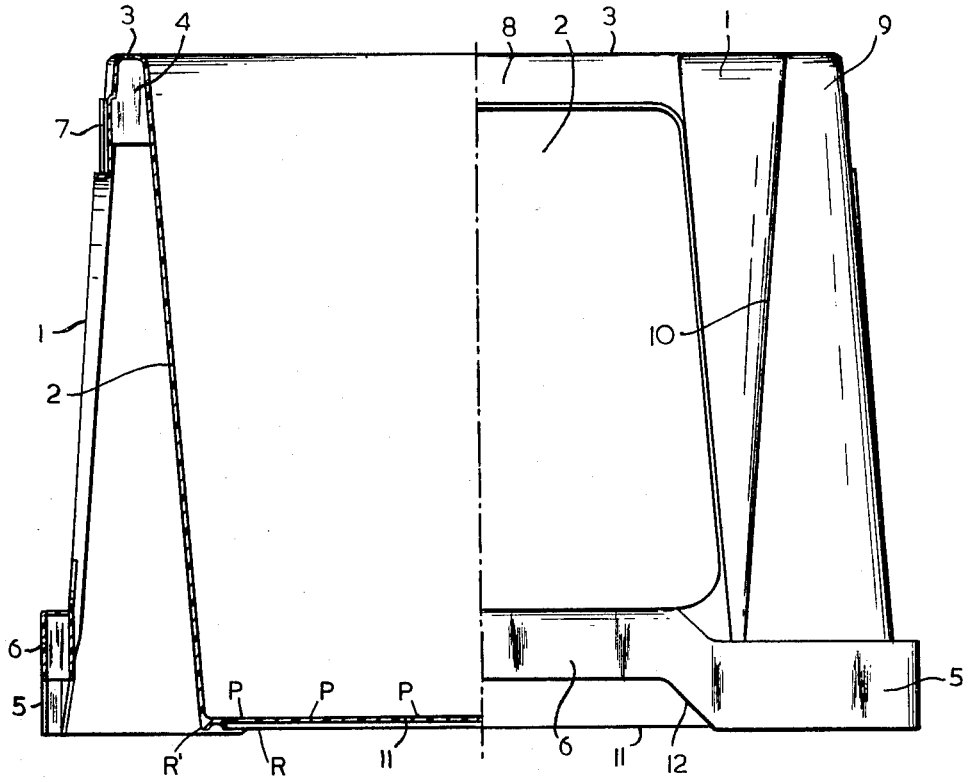
Figure 2:
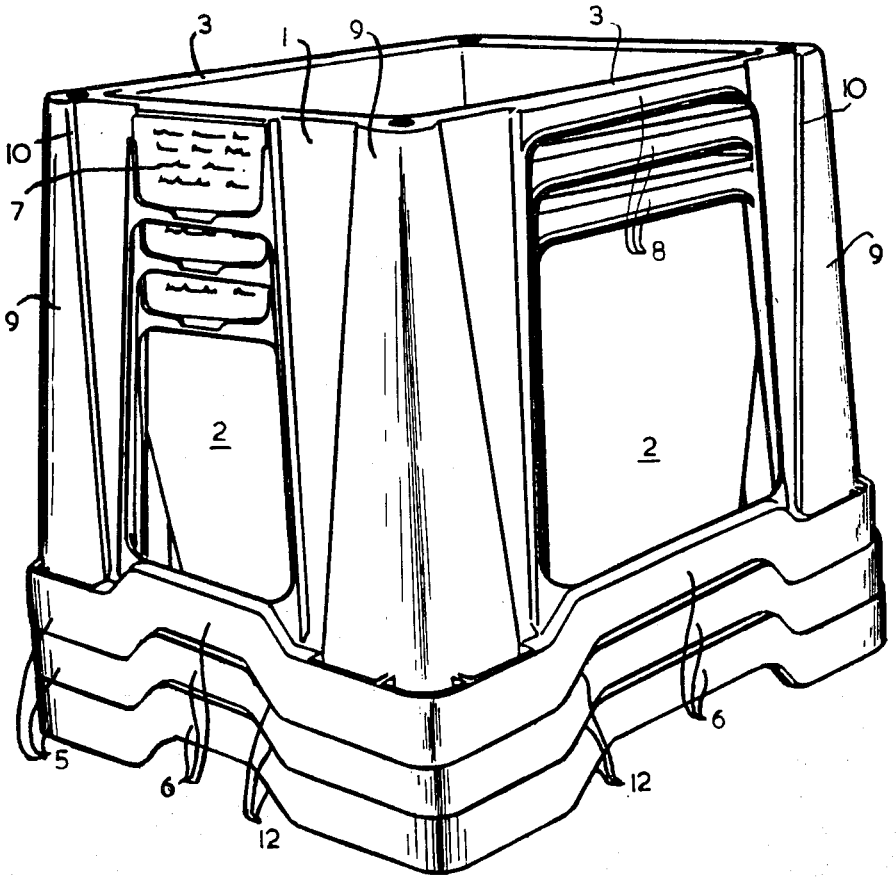

This object, and other objects and advantages of the present invention, will appear more clearly from the following specification in connection with the accompanying drawings, in which:

FIG. 1 is a vertical longitudinal section along the vertical plane of symmetry of the receptacle (left-hand side), and a lateral view of the longitudinal side of the receptacle (right-hand side); and FIG. 2 is a perspective sketch of three receptacles which have been stacked to form a nest.

The receptacle of the present invention is characterized primarily by being manufactured of synthetic material, having a substantially rectangular horizontal cross section, being provided with handgrips, and being double-walled in such a way as to be composed of an external container which is in the form of a truncated right pyramid facing upwards, and of an internal container which is provided with a substantially horizontal bottom and has the form of a truncated right pyramid facing downwards; the wall of the external container and that of the internal container are connected along the upper edge of the receptacle in such a way that the vertical section through both walls has substantially the form of an inverted "V", each leg of the "V" being inclined at an angle of at least 2° to the vertical, the various parts of the receptacle being mutually so dimensioned that a number of receptacles can be compactly stacked to form a nest.

The side walls of the external container of the receptacle according to the present invention can, in the lower-edge region, advantageously be provided with a U-shaped stiffening section, with handgrips being provided on at least two opposite sides at two different levels. The stiffening sections are so designed that, when the receptacles are stacked, the lower edge of an overlying receptacle rests upon the upper side of the stiffening section of the next underlying receptacle. When nesting the empty receptacles, it is thus possible to obtain high stacks of great stability. A lower handgrip is preferably formed by a port-shaped design of the stiffening section in the lower-edge region of the receptacle. The slanting end parts of the port-shaped part of the lower-edge can be so shaped that, when the receptacles are nested, the undersides of these end parts of an overlying receptacle rest upon the upper sides of the corresponding end parts of the port-shaped part of the next underlying receptacle. If four handgrips are provided at the lower-edge, this results in a mutual fixation of the nested receptacles in all directions in the horizontal plane.

Each of the four side walls of the external container can advantageously be provided with a substantially trapezoidal opening, along the upper edge of which a ridge is provided, which upper edge can serve as an upper handgrip. These openings moreover cause the weight of the receptacle, and therefore its manufacturing cost, to be reduced. In such a case, it is desirable to improve the rigidity of the structure by designing each of the four ribs of the truncated pyramid which forms the external container of the receptacle as a 90° sector of a truncated cone which faces upwards; these ribs may project from the surface by being staggered with respect to the side walls. The four resultant tapered corner columns, which constitute the four corners of the receptacle, ensure a satisfactory rigidity for the receptacle, allowing, among other things, its useful life to be extended.

In order to distribute to some extent the stresses which arise when the receptacles are nested, and to improve the rigidity of the structure, a number of substantially vertical partition plates can be provided in the space between the outside of the internal container and the inside of the external container near the upper edge of the receptacle. These partition plates can also serve as stopping devices, in which case, when the receptacles are nested, they rest upon the upper side of the upper edge of the next underlying receptacle.

In order to allow an identifying card or similar item, which relates for instance to the florist or to the contents of the receptacle, to be placed on the receptacle, one of the side walls of the external container can be provided with an assembly or grooved ridges which together form a card holder.

Since the receptacle is provided with handgrips on the upper side as well as on the lower side, the receptacle can be easily grasped and handled both in the filled and in the empty state. The receptacle can thus be held, as may be required, by the two lower handgrips, or with one hand at an upper handgrip, and with the other hand at a lower handgrip. This is especially important in loading and unloading the receptacles onto or from a vehicle. The lower handgrip furthermore allows the receptacle to be pulled along the ground without the possibility of overturning it.

Although bunched flowers may be stored and transported in a horizontal position, it has been established in recent years that vertical storage and transportation are preferred. The risk of damage to the flowers is thus reduced, and this method, if and when desired, facilitates maintaining the lower part of the stems in the water. This is especially important in case the flowers, after having been bunched and placed into the receptacle, are to be stored for a brief period of time (in cold storage, for example) before being conveyed to the auction. Accordingly, the bottom of the internal container of the receptacle is preferably provided with a number of ribs in order to prevent the stems of the bunches of flowers from sliding over the bottom when several bunches are taken from receptacle and the container is only filled in part.

The internal container can be entirely closed, so that its bottom is always covered with a layer of water surrounding the lower end of the flower stems. In many cases, however, the entire receptacle, with the bunches of flowers, is placed in a large, water-filled container, from which it is only removed a short time prior to transportation. When this procedure is followed, it is important for the water to run rapidly out of the internal container. This is why the internal container in such case is provided with drain ports, and dead corners are avoided in the design. Since the receptacle, while being unloaded from the platform of a van or truck, will often be tilted to some extent, catching of the bottom edge behind the edge of the loading platform is prevented by making the underside of the bottom of the internal container at least substantially flush with the underside of this bottom edge. The load is thus distributed on the bottom edge and this bottom, even when the receptacle is tilted during unloading.

In order to obviate jamming in the space between the external container and the internal container in the course of the tilting detachment of a rest of stacked receptacles, the angle at which the two legs of the cross section which is in the form of an inverted "V" are inclined to the vertical must not be smaller than 2°. Usually, however, a somewhat wider angle will be preferred, for instance one of 4° to 6°. Angles wider than 6° entail the drawback of an unacceptable loss of space. It will be clear that the two angles of the two legs of the inverted "V" to the vertical do not have to be identical.

The receptacle can be manufactured of any suitable synthetic material. Use is preferably made of polyethylene, polypropylene, or polyvinyl chloride, all of which are materials of sufficient strength which can be processed by conventional methods, such as injection molding.

Referring now to the drawings in detail, the left-hand side of FIG. 1 shows the short wall of the external container 1, and the wall of the internal container 2, in vertical section. Both containers have the shape of a truncated right pyramid, with the external container facing upwards, and the internal container facing downwards. The two walls are seen to be connected at the top by an edge 3, thus forming in section an inverted "V", the open end of which faces downwards. The inverted "V" accommodates near its upper edge 3 a few substantially vertical partition plates 4, which, when the receptacles are stacked to form a nest, rest upon the upper edge of the next underlying receptacle. The lower edge of the receptacle is provided with a U-shaped stiffening section 5, the central part 6 of which is port-shaped or raised so as to form a lower handgrip. At least one wall of the external container 1 of the receptacle is provided with several grooved ridges, which together form a card holder 7 into which an identifying card can be placed. The bottom 11 of the internal container 2 may be provided with ribs R, R′ and drain ports P. The right-hand side of FIG. 1 is an outside view of the longitudinal side of the receptacle. The wall of the external container 1 is here seen again, and, through the trapezoidal opening therein, so is the wall of the internal container 2. A ridge 8, provided along the upper edge 3 of the receptacle, forms the upper boundary of the trapezoidal opening, and can serve as an upper handgrip. The corner rib of the receptacle is formed by a corner column 9 which is in the form of a 90° sector of a truncated cone. The lower edge of the receptacle is provided with the U-shaped stiffening section 5, the central part 6 of which is port-shaped in order to serve as a lower handgrip. The bottom 11 of the internal container is seen to be substantially flush with the underside of the U-shaped stiffening section 5.

FIG. 2 shows three receptacles according to the invention which are stacked to form a nest. The external container 1 and the internal container 2 are here seen again, connected along their upper side by a top edge 3. Also shown are the corner columns 9, which, in order to enhance the rigidity of the receptacles, project slightly from the side wall of the external container, use being made of the staggered arrangement indicated by the number 10. Furthermore, the U-shaped stiffening section 5 is seen with the port-shaped part 6, the slanting end parts 12 of which are inclined at an angle of about 45° to the horizontal. When several receptacles are nested, these end parts rest upon the end parts of the port-shaped part of the lower edge of the next underlying receptacle, so that adjacent receptacles are securely fixed against lateral displacement in two mutually perpendicular directions in the horizontal plane. This results in outstanding stability of the nested stack.

The availability of two handgrips 6 and 8 at different levels allows the receptacle, both in the empty and in the filled state, to be handled smoothly, efficiently, and without particular physical effort in all areas specified in the introduction of this specification. In the embodiment described, the lower handgrips 6 are provided on all four sides, but the upper handgrips 8 only on the two large sides of the receptacle which are opposite to each other.

The present invention is, of course, in no way restricted to the specific disclosure of the specification and drawings, but also encompasses any modifications within the scope of the appended claims.

What I claim is:

1. A receptacle for the storage and shipment of cut flowers, said receptacle forming a stackable unitary structure molded of a synthetic material, comprising an inner container body in the shape of a truncated pyramid of substantially rectangular cross-sectional shape and having a flat horizontal bottom wall and four flat side walls upwardly and outwardly sloping from said bottom wall to terminate in an upper circumferential upper edge enclosing a rectangular opening of larger area than said bottom wall, an outer skirt structure enclosing said inner container body and having the general shape of a four-sided truncated pyramid of rectangular cross-section with downwardly and outwardly sloping sides, said skirt structure having a circumferential upper edge integrally connected to said container body upper edge, and a circumferential lower edge having support edge portions extending substantially in the plane of said container body bottom wall, said skirt structure in the region of said lower edge thereof having a stiffening section including a lower handgrip and including a circumferentially extending double-walled reinforcing rim of inverted U-shaped cross-section, said reinforcing rim having, at each side of said skirt structure, a raised central portion, the lower edge of which being at a level sufficiently above said lower edge support portions to form the lower handgrip allowing the insertion of a hand therebelow, each of said sides of said skirt structure having a central opening occupying the greater part of the surface area of said side, the central opening being enclosed by a top peripheral portion, bottom peripheral portion and opposed side peripheral portions defining upper, lower, and side edges, said central opening bounded at its lower edge by said raised central reinforcing rim portion and said opening having a flanged upper edge as a ridge forming an upper handgrip, said outer skirt structure forming, between said central openings in said four sides thereof, four corner posts each comprising a reinforcing rib portion in the shape of a 90° sector of a truncated upwardly tapering cone extending between said reinforcing rim and said upper edge of said skirt structure.

2. The receptacle of claim 1, in which the lower edge of each of said raised central portions of said reinforcing rim has a shape with downwardly and outwardly sloping sides.

3. The receptacle of claim 1, in which each of said central openings of said skirt structure sides has a trapezoidal shape.

4. The receptacle of claim 1, further comprising vertical extending plate portions provided in the upper part of the space between said inner container body and said outer skirt structure immediately adjacent said integrally connected upper edges of said body and structure.

5. The receptacle of claim 1, in which each of said side walls of said inner container body and the opposing side of said outer skirt structure are each inclined at an angle of 4° to 6° to the vertical when the receptacle is in an upright position.

6. A receptacle for cut flowers, said receptacle being made of synthetic material and having upper edges, having a substantially rectangular horizontal cross section when in the upright position, and being provided with handgrips, said receptacle comprising in combination:

an external container in the form of a truncated right pyramid, the narrower part of which faces upwards, said external container including a wall; and an internal container having a side wall and a substantially horizontal bottom and being in the form of a truncated right pyramid, the narrower part of which faces downwards, the wall of said external container, and the side wall of said internal container, being connected along the upper edges of said receptacle to form a double walled receptacle, said internal container and said external container being interconnected in such a way that a vertical section through said interconnected walls of said containers has the shape of an inverted "V" formed by a leg on each side thereof, each leg of which is inclined at an angle of at least 2° to the vertical when said receptacle is in an upright position; the various parts of said receptacle being dimensioned in such a way as to allow a number of such receptacles to be compactly stacked and nested together, said handgrips being provided at two different levels on at least two opposite side walls of said external container, the lower edge region of each side wall of said external container, remote from said upper edge of said receptacle, being provided with a stiffening section having a U-shaped cross section and including lower edges as well as upper sides thereof, said stiffening sections havng such a configuration that when said receptacles are stacked and nested together, the lower edges of the stiffening sections of a given receptacle rest at least in part upon the upper sides of the stiffening sections of the immediately underlying receptacle, each stiffening section including a raised central portion, the bottom edge of said central portion being higher than the bottom edge of the adjacent remaining portions of said stiffening section, said raised central portion forming the lower handgrip, each raised central portion having substantially horizontal upper and lower edges, and upper and lower slanted edges respectively forming a transition therefrom to the corresponding and also substantially horizontal upper and lower edges of the adjacent remaining portions of said stiffening section, said lower slanted edges of the raised central portions of a given receptacle resting at least in part upon the upper slanted edges of the raised central portions of the immediately underlying receptacle when said receptacles are stacked and nested together, the side walls of said external container being provided with substantially trapezoidal openings, with said upper edges of said receptacle forming ridges in the area of said openings, said ridges forming upper handgrips.

7. A receptacle in combination according to claim 6, in which the four corners of the truncated pyramid of said external container are respectively ribs which are in the form of a 90° sector of a truncated cone, the narrower part of which faces upwards.

8. A receptacle in combination according to claim 7, which includes a plurality of at least substantially vertical partition plates provided in the inverted "V" space between the outside of said internal container and the inside of said external container in the vicinity of said upper edge of said receptacle, the bottom of the partition plates of a given receptacle resting upon the upper edge of the immediately underlying receptacle when said receptacles are stacked and nested together.

9. A receptacle in combination according to claim 8, in which at least one side wall of said external container is provided with grooved ridges which form a holder for an identifying card.

10. A receptacle in combination according to claim 8, in which the inner side of said bottom of said internal container is provided with ribs.

11. A receptacle in combination according to claim 8, in which said internal container is provided with drain ports.

12. A receptacle in combination according to claim 8, in which the external side of said bottom of said internal container is at least substantially flush with the lower edges of said stiffening sections.

13. A receptacle in combination according to claim 12, in which a given leg of said inverted "V" section of said interconnected containers is inclined at an angle of 4° to 6° to the vertical when said receptacle is in an upright position.

* * * * *